US010859937B2

(12) United States Patent
Tzomik et al.

(10) Patent No.: US 10,859,937 B2
(45) Date of Patent: Dec. 8, 2020

(54) LIQUID ELECTROPHOTOGRAPHIC ADHESIVE COMPOSITION

(71) Applicant: HP Indigo B.V., Amstelveen (NL)

(72) Inventors: Inna Tzomik, Nes Ziona (IL); Ziv Gilan, Nes Ziona (IL); Faina Kogan, Nes Ziona (IL); Gleb Romantcov, Nes Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/470,110

(22) PCT Filed: Mar. 21, 2017

(86) PCT No.: PCT/EP2017/056712
§ 371 (c)(1),
(2) Date: Jun. 14, 2019

(87) PCT Pub. No.: WO2018/171873
PCT Pub. Date: Sep. 27, 2018

(65) Prior Publication Data

US 2020/0019078 A1 Jan. 16, 2020

(51) Int. Cl.

| | |
|---|---|
| ***G03G 9/13*** | (2006.01) |
| ***G03G 8/00*** | (2006.01) |
| ***G03G 15/10*** | (2006.01) |
| ***G03G 13/10*** | (2006.01) |

(52) U.S. Cl.
CPC ..... *G03G 9/132* (2013.01); *G03G 8/00* (2013.01); *G03G 9/131* (2013.01); *G03G 13/10* (2013.01); *G03G 15/10* (2013.01)

(58) Field of Classification Search
CPC ..... G03G 9/13; G03G 9/132; G03G 8/00; G03G 13/10
See application file for complete search history.

(56) References Cited

U.S. PATENT DOCUMENTS

| | | | | |
|---|---|---|---|---|
| 3,420,732 | A | 1/1969 | Bresina et al. | |
| 4,457,995 | A * | 7/1984 | Ikenoue | G03G 9/122 430/115 |
| 5,750,299 | A | 5/1998 | Ohshima et al. | |
| 5,958,643 | A * | 9/1999 | Fujiwara | G03G 9/1355 430/112 |
| 6,060,204 | A * | 5/2000 | Knapp | G03G 8/00 430/117.5 |
| 6,209,779 | B1 | 4/2001 | Fabel | |
| 6,509,128 | B1 * | 1/2003 | Everaerts | C09J 5/00 430/111.4 |
| 2012/0114893 | A1 | 5/2012 | Gavel et al. | |
| 2016/0168407 | A1 * | 6/2016 | Jarvis | G03G 7/00 424/443 |
| 2017/0009108 | A1 | 1/2017 | Mitchell et al. | |
| 2017/0336725 | A1 * | 11/2017 | Varnell | G03G 7/008 |

FOREIGN PATENT DOCUMENTS

| | | |
|---|---|---|
| WO | WO-2014206492 | 12/2014 |
| WO | WO-2016116141 | 7/2016 |
| WO | WO-2016173628 | 11/2016 |

OTHER PUBLICATIONS

Bunyel E418 Product Data Sheet. Dow Packaging & Speciality Plastics. 4 pages. (Year: 2019).*
International Search Report and Written Opinion for International Application No. PCT/EP2017/056712 dated Sep. 25, 2017, 14 pages.

* cited by examiner

*Primary Examiner* — Christopher D Rodee
(74) *Attorney, Agent, or Firm* — Dierker & Kavanaugh PC

(57) ABSTRACT

Herein is described a liquid electrophotographic adhesive composition comprising a thermoplastic resin, a moisture activatable adhesive, and a liquid carrier.

15 Claims, No Drawings

LIQUID ELECTROPHOTOGRAPHIC ADHESIVE COMPOSITION

BACKGROUND

Electrophotographic printing processes, sometimes termed electrostatic printing processes, typically involve creating an image on a photoconductive surface, applying an ink having charged particles to the photoconductive surface, such that they selectively bind to the image, and then transferring the charged particles in the form of the image to a print substrate.

The photoconductive surface may be on a cylinder and is often termed a photo imaging plate (PIP). The photoconductive surface is selectively charged with a latent electrostatic image having image and background areas with different potentials. For example, an electrostatic ink composition including charged toner particles in a liquid carrier can be brought into contact with the selectively charged photoconductive surface. The charged toner particles adhere to the image areas of the latent image while the background areas remain clean. The image is then transferred to a print substrate directly or, by being first transferred to an intermediate transfer member, which can be a soft swelling blanket, which is often heated to fuse the solid image and evaporate the liquid carrier, and then to the print substrate.

DETAILED DESCRIPTION

Before the compositions, methods and related aspects of the disclosure are disclosed and described, it is to be understood that this disclosure is not restricted to the particular process features and materials disclosed herein because such process features and materials may vary somewhat. It is also to be understood that the terminology used herein is used for the purpose of describing particular examples. The terms are not intended to be limiting because the scope is intended to be limited by the appended claims and equivalents thereof.

It is noted that, as used in this specification and the appended claims, the singular forms "a," "an," and "the" include plural referents unless the context clearly dictates otherwise.

As used herein, "liquid carrier", "carrier liquid", "carrier," or "carrier vehicle" refers to a fluid in which the thermoplastic resin, pigment, charge directors and/or other additives can be dispersed to form a liquid electrostatic composition or electrophotographic composition. The term "liquid carrier" is also used herein to refer to a fluid in which the thermoplastic resin, moisture activatable adhesive, charge directors and/or other additives can be dispersed to form the liquid electrophotographic adhesive composition as described herein. Liquid carriers can include a mixture of a variety of different agents, such as surfactants, co-solvents, viscosity modifiers, and/or other possible ingredients.

As used herein, "liquid electrophotographic (LEP) ink composition" or "liquid electrostatic ink composition" generally refers to an ink composition, in liquid form, generally suitable for use in an electrostatic printing process, sometimes termed an electrophotographic printing process. The electrostatic ink composition may include chargeable particles of the resin and the pigment dispersed in a liquid carrier, which may be as described herein.

As used herein, "liquid electrophotographic (LEP) adhesive composition" or "liquid electrostatic adhesive composition" generally refers to a composition, in liquid form, generally suitable for use in an electrostatic printing process, sometimes termed an electrophotographic printing process. The electrostatic adhesive composition may include chargeable particles of the resin and the moisture activatable adhesive dispersed in a liquid carrier, which may be as described herein.

As used herein, "co-polymer" refers to a polymer that is polymerized from at least two monomers.

As used herein, "melt flow rate" generally refers to the extrusion rate of a resin through an orifice of defined dimensions at a specified temperature and load, usually reported as temperature/load, e.g. 190° C./2.16 kg. Flow rates can be used to differentiate grades or provide a measure of degradation of a material as a result of molding. In the present disclosure, "melt flow rate" is measured per ASTM D1238-04c Standard Test Method for Melt Flow Rates of Thermoplastics by Extrusion Plastometer. If a melt flow rate of a particular polymer is specified, unless otherwise stated, it is the melt flow rate for that polymer alone, in the absence of any of the other components of the electrostatic composition.

As used herein, "acidity," "acid number," or "acid value" refers to the mass of potassium hydroxide (KOH) in milligrams that neutralizes one gram of a substance. The acidity of a polymer can be measured according to standard techniques, for example as described in ASTM D1386. If the acidity of a particular polymer is specified, unless otherwise stated, it is the acidity for that polymer alone, in the absence of any of the other components of the liquid toner composition.

As used herein, "melt viscosity" generally refers to the ratio of shear stress to shear rate at a given shear stress or shear rate. Testing is generally performed using a capillary rheometer. A plastic charge is heated in the rheometer barrel and is forced through a die with a plunger. The plunger is pushed either by a constant force or at constant rate depending on the equipment. Measurements are taken once the system has reached steady-state operation. One method used is measuring Brookfield viscosity @ 140° C., units are mPa–s or cPoise. In some examples, the melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate. If the melt viscosity of a particular polymer is specified, unless otherwise stated, it is the melt viscosity for that polymer alone, in the absence of any of the other components of the electrostatic composition.

A certain monomer may be described herein as constituting a certain weight percentage of a polymer. This indicates that the repeating units formed from the said monomer in the polymer constitute said weight percentage of the polymer.

If a standard test is mentioned herein, unless otherwise stated, the version of the test to be referred to is the most recent at the time of filing this patent application.

As used herein, "electrostatic(ally) printing" or "electrophotographic(ally) printing" generally refers to the process that provides an image that is transferred from a photo imaging substrate or plate either directly or indirectly via an intermediate transfer member to a print substrate, e.g. a paper substrate. As such, the image is not substantially absorbed into the photo imaging substrate or plate on which it is applied. Additionally, "electrophotographic printers" or "electrostatic printers" generally refer to those printers capable of performing electrophotographic printing or electrostatic printing, as described above. "Liquid electrophotographic printing" ("LEP printing") is a specific type of electrophotographic printing where a liquid ink is employed in the electrophotographic process rather than a powder toner. An electrostatic printing process may involve subjecting the electrophotographic ink composition to an electric field, e.g. an electric field having a field strength of 1000 V/cm or more, in some examples 1000 V/mm or more.

As used herein, the term "about" is used to provide flexibility to a numerical range endpoint by providing that a given value may be a little above or a little below the endpoint. The degree of flexibility of this term can be dictated by the particular variable.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not just the numerical values explicitly recited as the end points of the range, but also to include all the individual numerical values or sub-ranges encompassed within that range as if each numerical value and sub-range is explicitly recited. As an illustration, a numerical range of "about 1 wt % to about 5 wt %" should be interpreted to include not just the explicitly recited values of about 1 wt % to about 5 wt %, but also include individual values and subranges within the indicated range. Thus, included in this numerical range are individual values such as 2, 3.5, and 4 and sub-ranges such as from 1-3, from 2-4, and from 3-5, etc. This same principle applies to ranges reciting a single numerical value. Furthermore, such an interpretation should apply regardless of the breadth of the range or the characteristics being described.

As used herein, unless specified otherwise, wt % values are to be taken as referring to a weight-for-weight (w/w) percentage of solids in the ink composition, and not including the weight of any carrier fluid present.

Unless otherwise stated, any feature described herein can be combined with any aspect or any other feature described herein.

Previously, embellishing materials such as foils have been selectively applied to substrates using heat activated LEP adhesives. However, the present inventors have found that using heat activated adhesives may result in background contamination of a LEP ink image (e.g. coloured LEP ink) with an embellishing material, for example, as the LEP ink image may become tacky on exposure to the heat used to activate the adhesive which may result in the embellishing material sticking to the LEP ink image as well as the heat activated adhesive.

The present inventors have surprisingly found that a moisture activatable adhesive may be incorporated into a LEP composition by combining a moisture activatable adhesive with a thermoplastic resin (e.g. by grinding) and a carrier liquid to form a chargeable composition that is suitable for use in electrostatic printing.

The present inventors have found that a substrate, such as a LEP printed substrate, can be selectively embellished (e.g. foiled) using a LEP adhesive composition comprising a moisture activatable adhesive. The LEP adhesive composition may be selectively applied to a substrate by digitally printing the composition using a liquid electrophotographic printing apparatus. It has been found that LEP adhesive compositions described herein may be activated by application of water without causing a nearby printed LEP ink image to become tacky/sticky such that background contamination of a LEP ink image may be avoided.

In an aspect there is provided a liquid electrophotographic (LEP) adhesive composition. The LEP adhesive composition may comprise:

a thermoplastic resin;

a moisture activatable adhesive; and a liquid carrier.

In another aspect, there is provided a method comprising forming an adhesive image on a print substrate by electrophotographically printing a liquid electrophotographic (LEP) adhesive composition. In some examples, the method may comprise:

forming an adhesive image on a print substrate by electrophotographically printing a liquid electrophotographic adhesive composition comprising a thermoplastic resin, a moisture activatable adhesive and a liquid carrier on to the print substrate;

activating the adhesive image by applying water to the adhesive image; and applying an embellishing material to the activated adhesive image such that the embellishing material adheres to the activated adhesive image.

In another aspect, there is provided a liquid electrophotographic (LEP) printing composition set. The LEP printing composition set may comprise:

a liquid electrophotographic adhesive composition comprising:

a thermoplastic resin;

a moisture activatable adhesive; and a liquid carrier; and a liquid electrophotographic ink composition comprising:

a thermoplastic resin;

a pigment; and a liquid carrier.

Liquid Electrophotographic (LEP) Adhesive Composition

Described herein is a LEP adhesive composition comprising: a thermoplastic resin; a moisture activatable adhesive; and a liquid carrier.

Thermoplastic Resin

The LEP adhesive composition comprises a thermoplastic resin.

The LEP adhesive composition comprises chargeable particles, i.e. having or capable of developing a charge, for example in an electromagnetic field, including the thermoplastic resin and/or the moisture activatable adhesive.

The thermoplastic resin may coat, completely or partially, the moisture activatable adhesive. In some examples, the chargeable particles of the LEP adhesive composition comprise a core of a moisture activatable adhesive and have an outer layer of resin thereon. In some examples, the moisture activatable adhesive may be dispersed throughout each resin-containing particle.

The thermoplastic resin may comprise a copolymer of an alkylene monomer and a monomer selected from acrylic acid and methacrylic acid. The thermoplastic resin may be referred to as a thermoplastic polymer. In some examples, the polymer may comprise one or more of ethylene or propylene acrylic acid co-polymers; ethylene or propylene methacrylic acid co-polymers; ethylene vinyl acetate co-polymers; co-polymers of ethylene or propylene (e.g. 80 wt % to 99.9 wt %), and alkyl (e.g. C1 to C5) ester of methacrylic or acrylic acid (e.g. 0.1 wt % to 20 wt %); co-polymers of ethylene (e.g. 80 wt % to 99.9 wt %), acrylic or methacrylic acid (e.g. 0.1 wt % to 20.0 wt %) and alkyl (e.g. C1 to C5) ester of methacrylic or acrylic acid (e.g. 0.1 wt % to 20 wt %); co-polymers of ethylene or propylene (e.g. 70 wt % to 99.9 wt %) and maleic anhydride (e.g. 0.1 wt % to 30 wt %); polyethylene; polystyrene; isotactic polypropylene (crystalline); co-polymers of ethylene ethylene ethyl acrylate; polyesters; polyvinyl toluene; polyamides; styrene/butadiene co-polymers; epoxy resins; acrylic resins (e.g. co-polymer of acrylic or methacrylic acid and at least one alkyl ester of acrylic or methacrylic acid wherein alkyl may have from 1 to about 20 carbon atoms, such as methyl methacrylate (e.g. 50% to 90%)/methacrylic acid (e.g. 0 wt % to 20 wt %)/ethylhexylacrylate (e.g. 10 wt % to 50 wt %)); ethylene-acrylate terpolymers:ethylene-acrylic esters-maleic anhydride (MAH) or glycidyl methacrylate (GMA) terpolymers; ethylene-acrylic acid ionomers and combinations thereof.

The resin may comprise a polymer having acidic side groups. Examples of the polymer having acidic side groups will now be described. The polymer having acidic side groups may have an acidity of 50 mg KOH/g or more, in some examples an acidity of 60 mg KOH/g or more, in some examples an acidity of 70 mg KOH/g or more, in some examples an acidity of 80 mg KOH/g or more, in some examples an acidity of 90 mg KOH/g or more, in some examples an acidity of 100 mg KOH/g or more, in some examples an acidity of 105 mg KOH/g or more, in some examples 110 mg KOH/g or more, in some examples 115 mg KOH/g or more. The polymer having acidic side groups may have an acidity of 200 mg KOH/g or less, in some examples 190 mg or less, in some examples 180 mg or less, in some examples 130 mg KOH/g or less, in some examples 120 mg KOH/g or less. Acidity of a polymer, as measured in mg KOH/g can be measured using standard procedures known in the art, for example using the procedure described in ASTM D1386.

The resin may comprise a polymer having acidic side groups, that has a melt flow rate of less than about 70 g/10 minutes, in some examples about 60 g/10 minutes or less, in some examples about 50 g/10 minutes or less, in some examples about 40 g/10 minutes or less, in some examples 30 g/10 minutes or less, in some examples 20 g/10 minutes or less, in some examples 10 g/10 minutes or less. In some examples, all polymers having acidic side groups and/or ester groups in the particles each individually have a melt flow rate of less than 90 g/10 minutes, 80 g/10 minutes or less, in some examples 80 g/10 minutes or less, in some examples 70 g/10 minutes or less, in some examples 70 g/10 minutes or less, in some examples 60 g/10 minutes or less.

The polymer having acidic side groups can have a melt flow rate of about 10 g/10 minutes to about 120 g/10 minutes, in some examples about 10 g/10 minutes to about 70 g/10 minutes, in some examples about 10 g/10 minutes to 40 g/10 minutes, in some examples 20 g/10 minutes to 30 g/10 minutes. The polymer having acidic side groups can have a melt flow rate of, in some examples, about 50 g/10 minutes to about 120 g/10 minutes, in some examples 60 g/10 minutes to about 100 g/10 minutes. The melt flow rate can be measured using standard procedures known in the art, for example as described in ASTM D1238.

The acidic side groups may be in free acid form or may be in the form of an anion and associated with one or more counterions, typically metal counterions, e.g. a metal selected from the alkali metals, such as lithium, sodium and potassium, alkali earth metals, such as magnesium or calcium, and transition metals, such as zinc. The polymer having acidic sides groups can be selected from resins such as co-polymers of ethylene and an ethylenically unsaturated acid of either acrylic acid or methacrylic acid; and ionomers thereof, such as methacrylic acid and ethylene-acrylic or methacrylic acid co-polymers which are at least partially neutralized with metal ions (e.g. Zn, Na, Li) such as SURLYN® ionomers. The polymer comprising acidic side groups can be a co-polymer of ethylene and an ethylenically unsaturated acid of either acrylic or methacrylic acid, where the ethylenically unsaturated acid of either acrylic or methacrylic acid constitute from 5 wt % to about 25 wt % of the co-polymer, in some examples from 10 wt % to about 20 wt % of the co-polymer.

The resin may comprise two different polymers having acidic side groups. The two polymers having acidic side groups may have different acidities, which may fall within the ranges mentioned above. The resin may comprise a first polymer having acidic side groups that has an acidity of from 10 mg KOH/g to 110 mg KOH/g, in some examples 20 mg KOH/g to 110 mg KOH/g, in some examples 30 mg KOH/g to 110 mg KOH/g, in some examples 50 mg KOH/g to 110 mg KOH/g, and a second polymer having acidic side groups that has an acidity of 110 mg KOH/g to 130 mg KOH/g.

The resin may comprise two different polymers having acidic side groups: a first polymer having acidic side groups that has a melt flow rate of about 10 g/10 minutes to about 50 g/10 minutes and an acidity of from 10 mg KOH/g to 110 mg KOH/g, in some examples 20 mg KOH/g to 110 mg KOH/g, in some examples 30 mg KOH/g to 110 mg KOH/g, in some examples 50 mg KOH/g to 110 mg KOH/g, and a second polymer having acidic side groups that has a melt flow rate of about 50 g/10 minutes to about 120 g/10 minutes and an acidity of 110 mg KOH/g to 130 mg KOH/g. The first and second polymers may be absent of ester groups.

The ratio of the first polymer having acidic side groups to the second polymer having acidic side groups can be from about 10:1 to about 2:1. The ratio can be from about 6:1 to about 3:1, in some examples about 4:1.

The resin may comprise a polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; said polymer may be a polymer having acidic side groups as described herein. The resin may comprise a first polymer having a melt viscosity of 15000 poise or more, in some examples 20000 poise or more, in some examples 50000 poise or more, in some examples 70000 poise or more; and in some examples, the resin may comprise a second polymer having a melt viscosity less than the first polymer, in some examples a melt viscosity of 15000 poise or less, in some examples a melt viscosity of 10000 poise or less, in some examples 1000 poise or less, in some examples 100 poise or less, in some examples 50 poise or less, in some examples 10 poise or less. The resin may comprise a first polymer having a melt viscosity of more than 60000 poise, in some examples from 60000 poise to 100000 poise, in some examples from 65000 poise to 85000 poise; a second polymer having a melt viscosity of from 15000 poise to 40000 poise, in some examples 20000 poise to 30000 poise, and a third polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; an example of the first polymer is Nucrel®

960 (from DuPont), and example of the second polymer is Nucrel® 699 (from DuPont), and an example of the third polymer is AC®-5120 or AC®-5180 (from Honeywell). The first, second and third polymers may be polymers having acidic side groups as described herein. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 Hz shear rate.

If the resin comprises a single type of polymer, the polymer (excluding any other components of the electrophotographic adhesive composition) may have a melt viscosity of 6000 poise or more, in some examples a melt viscosity of 8000 poise or more, in some examples a melt viscosity of 10000 poise or more, in some examples a melt viscosity of 12000 poise or more. If the resin comprises a plurality of polymers all the polymers of the resin may together form a mixture (excluding any other components of the electrophotographic adhesive composition) that has a melt viscosity of 6000 poise or more, in some examples a melt viscosity of 8000 poise or more, in some examples a melt viscosity of 10000 poise or more, in some examples a melt viscosity of 12000 poise or more. Melt viscosity can be measured using standard techniques. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 Hz shear rate.

The resin may comprise two different polymers having acidic side groups that are selected from co-polymers of ethylene and an ethylenically unsaturated acid of either acrylic acid or methacrylic acid; or ionomers thereof, such as methacrylic acid and ethylene-acrylic or methacrylic acid co-polymers which are at least partially neutralized with metal ions (e.g. Zn, Na, Li) such as SURLYN® ionomers. The resin may comprise (i) a first polymer that is a co-polymer of ethylene and an ethylenically unsaturated acid of either acrylic acid and methacrylic acid, wherein the ethylenically unsaturated acid of either acrylic or methacrylic acid constitutes from 8 wt % to about 16 wt % of the co-polymer, in some examples 10 wt % to 16 wt % of the co-polymer; and (ii) a second polymer that is a co-polymer of ethylene and an ethylenically unsaturated acid of either acrylic acid and methacrylic acid, wherein the ethylenically unsaturated acid of either acrylic or methacrylic acid constitutes from 12 wt % to about 30 wt % of the co-polymer, in some examples from 14 wt % to about 20 wt % of the co-polymer, in some examples from 16 wt % to about 20 wt % of the co-polymer in some examples from 17 wt % to 19 wt % of the co-polymer.

The resin may comprise a polymer having acidic side groups, as described above (which may be free of ester side groups), and a polymer having ester side groups. The polymer having ester side groups may be a thermoplastic polymer. The polymer having ester side groups may further comprise acidic side groups. The polymer having ester side groups may be a co-polymer of a monomer having ester side groups and a monomer having acidic side groups. The polymer may be a co-polymer of a monomer having ester side groups, a monomer having acidic side groups, and a monomer absent of any acidic and ester side groups. The monomer having ester side groups may be a monomer selected from esterified acrylic acid or esterified methacrylic acid. The monomer having acidic side groups may be a monomer selected from acrylic or methacrylic acid. The monomer absent of any acidic and ester side groups may be an alkylene monomer, including, but not limited to, ethylene or propylene. The esterified acrylic acid or esterified methacrylic acid may, respectively, be an alkyl ester of acrylic acid or an alkyl ester of methacrylic acid. The alkyl group in the alkyl ester of acrylic or methacrylic acid may be an alkyl group having 1 to 30 carbons, in some examples 1 to 20 carbons, in some examples 1 to 10 carbons; in some examples selected from methyl, ethyl, iso-propyl, n-propyl, t-butyl, iso-butyl, n-butyl and pentyl.

The polymer having ester side groups may be a co-polymer of a first monomer having ester side groups, a second monomer having acidic side groups and a third monomer which is an alkylene monomer absent of any acidic and ester side groups. The polymer having ester side groups may be a co-polymer of (i) a first monomer having ester side groups selected from esterified acrylic acid or esterified methacrylic acid, in some examples an alkyl ester of acrylic or methacrylic acid, (ii) a second monomer having acidic side groups selected from acrylic or methacrylic acid and (iii) a third monomer which is an alkylene monomer selected from ethylene and propylene. The first monomer may constitute 1% to 50% by weight of the co-polymer, in some examples 5% to 40% by weight, in some examples 5% to 20% by weight of the co-polymer, in some examples 5% to 15% by weight of the co-polymer. The second monomer may constitute 1% to 50% by weight of the co-polymer, in some examples 5% to 40% by weight of the co-polymer, in some examples 5% to 20% by weight of the co-polymer, in some examples 5% to 15% by weight of the co-polymer. The first monomer can constitute 5% to 40% by weight of the co-polymer, the second monomer constitutes 5% to 40% by weight of the co-polymer, and with the third monomer constituting the remaining weight of the co-polymer. In some examples, the first monomer constitutes 5% to 15% by weight of the co-polymer, the second monomer constitutes 5% to 15% by weight of the co-polymer, with the third monomer constituting the remaining weight of the co-polymer. In some examples, the first monomer constitutes 8% to 12% by weight of the co-polymer, the second monomer constitutes 8% to 12% by weight of the co-polymer, with the third monomer constituting the remaining weight of the co-polymer. In some examples, the first monomer constitutes about 10% by weight of the co-polymer, the second monomer constitutes about 10% by weight of the co-polymer, and with the third monomer constituting the remaining weight of the co-polymer. The polymer may be selected from the Bynel® class of monomer, including Bynel® 2022 and Bynel® 2002, which are available from DuPont®.

The polymer having ester side groups may constitute 1% or more by weight of the total amount of the resin polymers, e.g. thermoplastic resin polymers, in the liquid electrophotographic adhesive composition and/or the adhesive composition printed on the print substrate, e.g. the total amount of the polymer or polymers having acidic side groups and polymer having ester side groups. The polymer having ester side groups may constitute 5% or more by weight of the total amount of the resin polymers, e.g. thermoplastic resin polymers, in some examples 8% or more by weight of the total amount of the resin polymers, e.g. thermoplastic resin polymers, in some examples 10% or more by weight of the total amount of the resin polymers, e.g. thermoplastic resin polymers, in some examples 15% or more by weight of the total amount of the resin polymers, e.g. thermoplastic resin polymers, in some examples 20% or more by weight of the total amount of the resin polymers, e.g. thermoplastic resin polymers, in some examples 25% or more by weight of the total amount of the resin polymers, e.g. thermoplastic resin polymers, in some examples 30% or more by weight of the total amount of the resin polymers, e.g. thermoplastic resin polymers, in some examples 35% or more by weight of the total amount of the resin polymers, e.g. thermoplastic resin polymers, in the liquid electrophotographic adhesive composition and/or the composition printed on the print substrate. The polymer having ester side groups may constitute from 5% to 50% by weight of the total amount of the resin polymers, e.g. thermoplastic resin polymers, in the liquid electrophotographic composition and/or the composition printed on the print substrate, in some examples 10% to 40% by weight of the total amount of the resin polymers, e.g. thermoplastic resin polymers, in the liquid electrophotographic composition and/or the composition printed on the print substrate, in some examples 5% to 30% by weight of the total amount of the resin polymers, e.g. thermoplastic resin polymers, in the liquid electrophotographic composition and/or the composition printed on the print substrate, in some examples 5% to 15% by weight of the total amount of the resin polymers, e.g. thermoplastic resin polymers, in the liquid electrophotographic composition and/or the composition printed on the print substrate in some examples 15% to 30% by weight of the total amount of the resin polymers, e.g. thermoplastic resin polymers, in the liquid electrophotographic composition and/or the composition printed on the print substrate.

The polymer having ester side groups may have an acidity of 50 mg KOH/g or more, in some examples an acidity of 60 mg KOH/g or more, in some examples an acidity of 70 mg KOH/g or more, in some examples an acidity of 80 mg KOH/g or more. The polymer having ester side groups may have an acidity of 100 mg KOH/g or less, in some examples 90 mg KOH/g or less. The polymer having ester side groups may have an acidity of 60 mg KOH/g to 90 mg KOH/g, in some examples 70 mg KOH/g to 80 mg KOH/g.

The polymer having ester side groups may have a melt flow rate of about 10 g/10 minutes to about 120 g/10 minutes, in some examples about 10 g/10 minutes to about 50 g/10 minutes, in some examples about 20 g/10 minutes to about 40 g/10 minutes, in some examples about 25 g/10 minutes to about 35 g/10 minutes.

The polymer, polymers, co-polymer or co-polymers of the resin can in some examples be selected from the Nucrel® family of toners (e.g. Nucrel 403™, Nucrel 407™ Nucrel 609HS™, Nucrel 908HS™, Nucrel 1202HC™, Nucrel 30707™ Nucrel 1214™, Nucrel 903™, Nucrel 3990™, Nucrel 910™, Nucrel 925™, Nucrel 699™, Nucrel 599™, Nucrel 960™, Nucrel RX76™, Nucrel 2806™, Bynell 2002™, Bynell 2014™, Bynell 2020™ and Bynell 2022™, (sold by E. I. du PONT™)), the AC® family of toners (e.g. AC-5120™, AC-5180™, AC-540™, AC-580™ (sold by Honeywell™)), the Aclyn™ family of toners (e.g. Aclyn 201™, Aclyn 246™, Aclyn 285™, and Aclyn 295™), and the Lotader™ family of toners (e.g. Lotader 2210™, Lotader, 3430™, and Lotader 8200™ (sold by Arkema™)).

The resin can constitute about 15 to 80%, for example about 20 to about 80%, or about 20 to about 70% by weight of the solids of the liquid electrophotographic adhesive composition and/or the adhesive image printed on the print substrate. The resin can constitute about 25 to 70%, in some examples about 25 to about 50 to %, by weight of the solids of the liquid electrophotographic adhesive composition and/or the adhesive image printed on the print substrate.

Moisture Activatable Adhesive

The LEP adhesive composition comprises a moisture activatable adhesive. A moisture activatable adhesive is an additive that becomes tacky/sticky on exposure to water. Any moisture activatable adhesive that may be incorporated into a LEP composition for LEP printing may be used.

Examples of suitable moisture activatable adhesives include cellulose derivatives (for example alkyl celluloses, hydroxyl alkyl celluloses and alkyl hydroxyl alkyl celluloses, where, in some examples, an alkyl group is a $C_{1-6}$, for example a $C_{1-4}$, or $C_{1-3}$ alkyl group), starches, dextrins, natural gums (e.g. polysaccharides derived from natural sources such as plants or bacteria fermentation, such as acacia gum (also known as gum arabic), xantham gum or agar), gelatin, polyvinyl alcohol, polyvinyl esters (such as polyvinyl acetates), and combinations thereof.

In some examples, the moisture activatable adhesive may comprise, consist essentially of, or consist of hydroxyl methyl cellulose, 2-hydroxy ethyl cellulose, hydroxypropyl methyl cellulose, ethyl hydroxyethyl cellulose, methyl (2-hydroxypropyl) cellulose, methyl cellulose, xantham gum, agar (agarose), acacia gum, powdered gelatin, polyvinyl alcohol, polyvinyl esters (e.g. polyvinyl acetate), and combinations thereof.

In some examples, the moisture activatable adhesive is selected from a cellulose derivative and a natural gum. In some examples, the cellulose derivative is selected from alkyl celluloses, hydroxyl alkyl celluloses and alkyl hydroxyl alkyl celluloses where the alkyl groups are selected from a $C_{1-6}$alkyl group, for example a $C_{1-4}$, or $C_{1-3}$ alkyl group. In some examples, the cellulose derivative is selected from hydroxyl methyl cellulose, 2-hydroxy ethyl cellulose, hydroxypropyl methyl cellulose, ethyl hydroxyethyl cellulose, methyl (2-hydroxypropyl) cellulose and methyl cellulose. In some examples the natural gum is a polysaccharide derived from a natural source, for example derived from a plant or bacteria source. In some examples the natural gum is selected from xantham gum, agar (agarose), and acacia gum.

In some examples, the LEP adhesive composition comprises at least about 30 wt % of a moisture activatable adhesive by total solids of the composition, for example at least about 40 wt %, at least about 50 wt %, at least about 60 wt %, at least about 65 wt %, or about 70 wt % of a moisture activatable adhesive by total solids of the composition.

In some examples, the LEP adhesive composition comprises up to about 90 wt % of a moisture activatable adhesive by total solids of the composition, for example up to about 85 wt %, up to about 80 wt %, up to about 75 wt %, or about 70 wt % of a moisture activatable adhesive by total solids of the composition.

In some examples, the LEP adhesive composition comprises from about 30 wt % to about 90 wt % of a moisture activatable adhesive by total solids of the composition, for example from about 30 wt % to about 80 wt %, from about 30 wt % to about 70 wt %, from about 50 wt % to about 80 wt %, from about 50 wt % to about 75 wt %, or from about 50 wt % to about 70 wt % by total solids of the composition.

The moisture activatable adhesive can constitute about 30 to 90%, for example about 30 to about 75%, or about 30 to about 70% by weight of the solids of the adhesive image printed on the print substrate. The moisture activatable adhesive can constitute about 50 to 80%, in some examples about 50 to about 70 to %, by weight of the solids of the adhesive image printed on the print substrate.

Liquid Carrier

The LEP adhesive composition may include a liquid carrier. In some examples, the LEP adhesive composition comprises particles including the resin and/or moisture activatable adhesive that may be dispersed in the liquid carrier. The liquid carrier can include or be a hydrocarbon, silicone oil, vegetable oil, etc. The liquid carrier can include, for example, an insulating, non-polar, non-aqueous liquid that can be used as a medium for particles of the LEP adhesive composition, i.e. the particles including the resin and/or moisture activatable adhesive. The liquid carrier can include compounds that have a resistivity in excess of about $10^9$ ohm·cm. The liquid carrier may have a dielectric constant below about 5, in some examples below about 3. The liquid carrier can include hydrocarbons. The hydrocarbon can include, for example, an aliphatic hydrocarbon, an isomerized aliphatic hydrocarbon, branched chain aliphatic hydrocarbons, aromatic hydrocarbons, and combinations thereof. Examples of the liquid carriers include, for example, aliphatic hydrocarbons, isoparaffinic compounds, paraffinic compounds, dearomatized hydrocarbon compounds, and the like. In particular, the liquid carriers can include, for example, Isopar-G™, Isopar-H™, Isopar-L™, Isopar-M™, Isopar-K™, Isopar-V™, Norpar 12™, Norpar 13™, Norpar 15™, Exxol D40™, Exxol D80™, Exxol D100™ Exxol D130™, and Exxol D140™ (each sold by EXXON CORPORATION); Teclen N-16™, Teclen N-20™, Teclen N-22™, Nisseki Naphthesol L™, Nisseki Naphthesol M™, Nisseki Naphthesol H™, #0 Solvent L™, #0 Solvent M™, #0 Solvent H™, Nisseki Isosol 300™, Nisseki Isosol 400™, AF-4™, AF-5™, AF-6™ and AF-7™ (each sold by NIPPON OIL CORPORATION); IP Solvent 1620™ and IP Solvent 2028™ (each sold by IDEMITSU PETROCHEMICAL CO., LTD.); Amsco OMS™ and Amsco 460™ (each sold by AMERICAN MINERAL SPIRITS CORP.); and Electron, Positron, New II, Purogen HF (100% synthetic terpenes) (sold by ECOLINK™)

The liquid carrier can constitute about 20% to 99.5% by weight of the LEP adhesive composition, in some examples 50% to 99.5% by weight of the LEP adhesive composition. The liquid carrier may constitute about 40 to 90% by weight of the LEP adhesive composition. The liquid carrier may constitute about 60% to 80% by weight of the LEP adhesive composition. The liquid carrier may constitute about 90% to 99.5% by weight of the LEP adhesive composition, in some examples 95% to 99% by weight of the LEP adhesive composition.

The LEP adhesive composition, when printed on a print substrate, may be substantially free from liquid carrier. In an electrostatic printing process and/or afterwards, the liquid carrier may be removed, e.g. by an electrophoresis processes during printing and/or evaporation, such that substantially just solids are transferred to the print substrate. Substantially free from liquid carrier may indicate that the composition printed on the print substrate contains less than 5 wt % liquid carrier, in some examples, less than 2 wt % liquid carrier, in some examples less than 1 wt % liquid carrier, in some examples less than 0.5 wt % liquid carrier. In some examples, the composition printed on the print substrate is free from liquid carrier.

Charge Director

In some examples, the LEP adhesive composition includes a charge director. The charge director may be added to a LEP adhesive composition in order to impart and/or maintain sufficient electrostatic charge on the particles of the composition. In some examples, the charge director may comprise ionic compounds, particularly metal salts of fatty acids, metal salts of sulfo-succinates, metal salts of oxyphosphates, metal salts of alkyl-benzenesulfonic acid, metal salts of aromatic carboxylic acids or sulfonic acids, as well as zwitterionic and non-ionic compounds, such as polyoxyethylated alkylamines, lecithin, polyvinylpyrrolidone, organic acid esters of polyvalent alcohols, etc. The charge director can be selected from, but is not limited to, oil-soluble petroleum sulfonates (e.g. neutral Calcium Petronate™, neutral Barium Petronate™, and basic Barium Petronate™) polybutylene succinimides (e.g. OLOA™1200 and Amoco 575), and glyceride salts (e.g. sodium salts of phosphated mono- and diglycerides with unsaturated and saturated acid substituents), sulfonic acid salts including, but not limited to, barium, sodium, calcium, and aluminum salts of sulfonic acid. The sulfonic acids may include, but are not limited to, alkyl sulfonic acids, aryl sulfonic acids, and sulfonic acids of alkyl succinates. The charge director can impart a negative charge or a positive charge on the resin-containing particles of a LEP adhesive composition.

The charge director may be added in order to impart and/or maintain sufficient electrostatic charge on particles of the LEP adhesive composition, which may be particles comprising the thermoplastic resin and/or a moisture activatable adhesive.

In some examples, the LEP adhesive composition comprises a charge director comprising a simple salt. The ions constructing the simple salts are all hydrophilic. The simple salt may include a cation selected from the group consisting of Mg, Ca, Ba, $NH_4$, tert-butyl ammonium, $Li^+$, and $Al^{+3}$, or from any sub-group thereof. The simple salt may include an anion selected from the group consisting of $SO_4^{2-}$, $PO^{3-}$, $NO^{3-}$, $HPO_4^{2-}$, $CO_3^{2-}$, acetate, trifluoroacetate (TFA), $Cl^-$, $BF_4^-$, $F^-$, $ClO_4^-$, and $TiO_3^{4-}$ or from any sub-group thereof. The simple salt may be selected from $CaCO_3$, $Ba_2TiO_3$, $Al_2(SO_4)$, $Al(NO_3)_3$, $Ca_3(PO_4)_2$, $BaSO_4$, $BaHPO_4$, $Ba_2(PO_4)_3$, $CaSO_4$, $(NH_4)_2CO_3$, $(NH_4)_2SO_4$, $NH_4OAc$, Tert-butyl ammonium bromide, $NH_4NO_3$, LiTFA, $Al_2(SO_4)_3$, $LiClO_4$ and $LiBF_4$, or any sub-group thereof.

In some examples, the LEP adhesive composition comprises a charge director comprising a sulfosuccinate salt of the general formula $MA_n$, wherein M is a metal, n is the valence of M, and A is an ion of the general formula (I): $[R^1—O—C(O)CH_2CH(SO_3^-)C(O)—O—R^2]$, wherein each of $R^1$ and $R^2$ is an alkyl group. In some examples each of $R_1$ and $R_2$ is an aliphatic alkyl group. In some examples, each of $R_1$ and $R_2$ independently is a C6-25 alkyl. In some examples, said aliphatic alkyl group is linear. In some examples, said aliphatic alkyl group is branched. In some examples, said aliphatic alkyl group includes a linear chain of more than 6 carbon atoms. In some examples, $R_1$ and $R_2$ are the same. In some examples, at least one of $R_1$ and $R_2$ is $C_{13}H_{27}$. In some examples, M is Na, K, Cs, Ca, or Ba.

In some examples, the charge director comprises at least one micelle forming salt and nanoparticles of a simple salt as described above. The simple salts are salts that do not form micelles by themselves, although they may form a core for micelles with a micelle forming salt. The sulfosuccinate salt of the general formula $MA_n$ is an example of a micelle forming salt. The charge director may be substantially free of an acid of the general formula HA, where A is as described above. The charge director may include micelles of said sulfosuccinate salt enclosing at least some of the nanoparticles of the simple salt. The charge director may include at least some nanoparticles of the simple salt having a size of 200 nm or less, and/or in some examples 2 nm or more.

In some examples, the charge director constitutes about 0.001% to 20%, in some examples 0.01% to 20% by weight, in some examples 0.01 to 10% by weight, in some examples 0.01% to 1% by weight of the solids of an LEP adhesive composition. In some examples, the charge director constitutes about 0.001% to 0.15% by weight of the solids of the LEP adhesive composition, in some examples 0.001% to 0.15%, in some examples 0.001% to 0.02% by weight of the solids of a LEP adhesive composition, in some examples 0.1% to 2% by weight of the solids of the LEP adhesive composition, in some examples 0.2% to 1.5% by weight of the solids of the LEP adhesive composition in some examples 0.1% to 1% by weight of the solids of the LEP adhesive composition, in some examples 0.2% to 0.8% by weight of the solids of the LEP adhesive composition.

In some examples, the charge director is present in an amount of from 3 mg/g to 20 mg/g, in some examples from 3 mg/g to 15 mg/g, in some examples from 10 mg/g to 15 mg/g, in some examples from 5 mg/g to 10 mg/g (where mg/g indicates mg per gram of solids of the LEP adhesive composition).

Other Additives

The LEP adhesive composition may include another additive or a plurality of other additives. The other additive or plurality of other additives may be added at any stage of the method. The other additive or plurality of other additives may be selected from a charge adjuvant, a surfactant, viscosity modifiers, and compatibility additives.

In some examples, the LEP adhesive composition includes a charge adjuvant. A charge adjuvant may promote charging of the particles when a charge director is present. The charge adjuvant can include, for example, barium petronate, calcium petronate, Co salts of naphthenic acid, Ca salts of naphthenic acid, Cu salts of naphthenic acid, Mn salts of naphthenic acid, Ni salts of naphthenic acid, Zn salts of naphthenic acid, Fe salts of naphthenic acid, Ba salts of stearic acid, Co salts of stearic acid, Pb salts of stearic acid, Zn salts of stearic acid, Al salts of stearic acid, Zn salts of stearic acid, Cu salts of stearic acid, Pb salts of stearic acid, Fe salts of stearic acid, metal carboxylates (e.g., Al tristearate, Al octanoate, Li heptanoate, Fe stearate, Fe distearate, Ba stearate, Cr stearate, Mg octanoate, Ca stearate, Fe naphthenate, Zn naphthenate, Mn heptanoate, Zn heptanoate, Ba octanoate, Al octanoate, Co octanoate, Mn octanoate, and Zn octanoate), Co lineolates, Mn lineolates, Pb lineolates, Zn lineolates, Ca oleates, Co oleates, Zn palmirate, Ca resinates, Co resinates, Mn resinates, Pb resinates, Zn resinates, AB diblock copolymers of 2-ethylhexyl methacrylate-co-methacrylic acid calcium and ammonium salts, copolymers of an alkyl acrylamidoglycolate alkyl ether (e.g., methyl acrylamidoglycolate methyl ether-co-vinyl acetate), or hydroxy bis(3,5-di-tert-butyl salicylic) aluminate monohydrate. In an example, the charge adjuvant is or includes aluminum di- or tristearate. In some examples, the charge adjuvant is VCA (an aluminium stearate, available from Sigma Aldrich).

The charge adjuvant may be present in an amount of about 0.1 to 5% by weight, in some examples about 0.1 to 1% by weight, in some examples about 0.3 to 0.8% by weight of the solids of the LEP adhesive composition, in some examples about 1 wt % to 3 wt % of the solids of the LEP adhesive composition, in some examples about 1.5 wt % to 2.5 wt % of the solids of the LEP adhesive composition.

The charge adjuvant may be present in an amount of less than 5.0% by weight of total solids of the LEP adhesive composition, in some examples in an amount of less than 4.5% by weight, in some examples in an amount of less than 4.0% by weight, in some examples in an amount of less than 3.5% by weight, in some examples in an amount of less than 3.0% by weight, in some examples in an amount of less than 2.5% by weight, in some examples about 2.0% or less by weight of the solids of the LEP adhesive composition.

In some examples, the LEP adhesive composition further includes, e.g. as a charge adjuvant, a salt of multivalent cation and a fatty acid anion. The salt of multivalent cation and a fatty acid anion can act as a charge adjuvant. The multivalent cation may, in some examples, be a divalent or a trivalent cation. In some examples, the multivalent cation is selected from Group 2, transition metals and Group 3 and Group 4 in the Periodic Table. In some examples, the multivalent cation includes a metal selected from Ca, Sc, Ti, V, Cr, Mn, Fe, Co, Ni, Cu, Zn, Al and Pb. In some examples, the multivalent cation is $Al^{3+}$. The fatty acid anion may be selected from a saturated or unsaturated fatty acid anion. The fatty acid anion may be selected from a $C_8$ to $C_{26}$ fatty acid anion, in some examples a $C_{14}$ to $C_{22}$ fatty acid anion, in some examples a C16 to C20 fatty acid anion, in some examples a $C_{17}$, $C_{18}$ or $C_{19}$ fatty acid anion. In some examples, the fatty acid anion is selected from a caprylic acid anion, capric acid anion, lauric acid anion, myristic acid anion, palmitic acid anion, stearic acid anion, arachidic acid anion, behenic acid anion and cerotic acid anion.

The charge adjuvant, which may, for example, be or include a salt of a multivalent cation and a fatty acid anion, may be present in an amount of 0.1 wt % to 5 wt % of the solids of the LEP adhesive composition, in some examples in an amount of 0.1 wt % to 2 wt % of the solids of the LEP adhesive composition, in some examples in an amount of 0.1 wt % to 2 wt % of the solids of the LEP adhesive composition, in some examples in an amount of 0.3 wt % to 1.5 wt % of the solids of the LEP adhesive composition, in some examples about 0.5 wt % to 1.2 wt % of the solids of the LEP adhesive composition, in some examples about 0.8 wt % to 1 wt % of the solids of the LEP adhesive composition, in some examples about 1 wt % to 3 wt % of the solids of the LEP adhesive composition, in some examples about 1.5 wt % to 2.5 wt % of the solids of the LEP adhesive composition.

In some examples, the LEP adhesive composition lacks a colorant. In some examples, the LEP adhesive composition is substantially transparent when printed. In some examples, the LEP adhesive composition may be a substantially colorless, clear or transparent composition substantially free from pigment. In examples in which the LEP adhesive compositions are substantially free from pigment, they may be used as adhesives in the methods described herein without contributing a further subtractive effect on the CMYK inks that would substantially affect the color of an underprinted colored image.

As used herein, "substantially free from pigment" is used to describe a LEP adhesive composition in which less than 1 wt % of the solids in the LEP adhesive composition are made up of colorant, in some examples less than 0.5 wt % of the solids in the LEP adhesive composition are made up of colorant, in some examples less than 0.1 wt % of the solids in the LEP adhesive composition are made up of colorant, in some examples less than 0.05 wt % of the solids in the LEP adhesive composition are made up of colorant, in some examples less than 0.01 wt % of the solids in the LEP adhesive composition are made up of colorant.

Liquid Electrophotographic (LEP) Ink Composition

Described herein is a LEP ink composition comprising a thermoplastic resin, a pigment, and a liquid carrier.

Examples of the LEP ink(s) include any commercially available LEP ink (e.g., Electrolnk® available from HP Indigo).

Thermoplastic Resin of the LEP Ink Composition

The LEP ink composition comprises a thermoplastic resin.

The LEP ink composition comprises chargeable ink particles, i.e. having or capable of developing a charge, for example in an electromagnetic field, including the thermoplastic resin and/or the pigment. The thermoplastic resin may coat, completely or partially, the pigment. In some examples, the chargeable ink particles comprise a core of a pigment and have an outer layer of resin thereon. In some examples, the pigment may be dispersed throughout each resin-containing ink particle.

The thermoplastic resin may comprise a copolymer of an alkylene monomer and a monomer selected from acrylic acid and methacrylic acid. The thermoplastic resin may be as described above for the thermoplastic resin of the LEP adhesive composition.

The resin can constitute about 5 to 90%, in some examples about 50 to 80%, by weight of the solids of the liquid electrophotographic ink composition and/or the ink composition printed on the print substrate. The resin can constitute about 60 to 95%, in some examples about 70 to 95%, by weight of the solids of the liquid electrophotographic ink composition and/or the ink composition printed on the print substrate.

In some examples, the thermoplastic resin of the LEP ink composition and the thermoplastic resin of the LEP adhesive composition both comprise a copolymer of an alkylene monomer and a monomer selected from acrylic acid and methacrylic acid.

Pigment

The LEP ink (pigmented LEP ink) includes a colourant. The colorant may be a dye or pigment. The colorant can be any colorant compatible with the liquid carrier and useful for electrophotographic printing. For example, the colorant may be present as pigment particles, or may comprise a resin (in addition to the polymers described herein) and a pigment. The resins and pigments can be any of those standardly used in the art. In some examples, the colorant is selected from a cyan pigment, a magenta pigment, a yellow pigment and a black pigment. For example, pigments by Hoechst including Permanent Yellow DHG, Permanent Yellow GR, Permanent Yellow G, Permanent Yellow NCG-71, Permanent Yellow GG, Hansa Yellow RA, Hansa Brilliant Yellow 5GX-02, Hansa Yellow X, NOVAPERM® YELLOW HR, NOVAPERM® YELLOW FGL, Hansa Brilliant Yellow 10GX, Permanent Yellow G3R-01, HOSTAPERM® YELLOW H4G, HOSTAPERM® YELLOW H3G, HOSTAPERM® ORANGE GR, HOSTAPERM® SCARLET GO, Permanent Rubine F6B; pigments by Sun Chemical including L74-1357 Yellow, L75-1331 Yellow, L75-2337 Yellow; pigments by Heubach including DALAMAR® YELLOW YT-858-D; pigments by Ciba-Geigy including CROMOPHTHAL® YELLOW 3 G, CROMOPHTHAL® YELLOW GR, CROMOPHTHAL® YELLOW 8 G, IRGAZINE® YELLOW 5GT, IRGALITE® RUBINE 4BL, MONASTRAL® MAGENTA, MONASTRAL® SCARLET, MONASTRAL® VIOLET, MONASTRAL® RED, MONASTRAL® VIOLET; pigments by BASF including LUMOGEN® LIGHT YELLOW, PALIOGEN® ORANGE, HELIOGEN® BLUE L 690 IF, HELIOGEN® BLUE TBD 7010, HELIOGEN® BLUE K 7090, HELIOGEN® BLUE L 710 IF, HELIOGEN® BLUE L 6470, HELIOGEN® GREEN K 8683, HELIOGEN® GREEN L 9140; pigments by Mobay including QUINDO® MAGENTA, INDOFAST® BRILLIANT SCARLET, QUINDO® RED 6700, QUINDO® RED 6713, INDOFAST® VIOLET; pigments by Cabot including Maroon B STERLING® NS BLACK, STERLING® NSX 76, MOGUL® L; pigments by DuPont including TIPURE® R-101; and pigments by Paul Uhlich including UHLICH® BK 8200. Where the pigment is a white pigment particle, the pigment particle may be selected from the group consisting of $TiO_2$, calcium carbonate, zinc oxide, and mixtures thereof. In some examples the white pigment particle may comprise an alumina-$TiO_2$ pigment.

The colorant or pigment particle may be present in the LEP ink composition in an amount of from 10 wt % to 80 wt % of the total amount of resin and pigment, in some examples 15 wt % to 80 wt %, in some examples 15 wt % to 60 wt %, in some examples 15 wt % to 50 wt %, in some examples 15 wt % to 40 wt %, in some examples 15 wt % to 30 wt % of the total amount of resin and colorant. In some examples, the colorant or pigment particle may be present in the LEP ink in an amount of at least 50 wt % of the total amount of resin and colorant or pigment, for example at least 55 wt % of the total amount of resin and colorant or pigment.

Liquid Carrier

The electrostatic ink composition includes a liquid carrier. In some examples, the electrostatic ink composition comprises ink particles including the resin may be dispersed in the liquid carrier. The liquid carrier may be as described above for the liquid carrier of the LEP adhesive composition.

The liquid carrier can constitute about 20% to 99.5% by weight of the electrostatic ink composition, in some examples 50% to 99.5% by weight of the electrostatic ink composition. The liquid carrier may constitute about 40 to 90% by weight of the electrostatic ink composition. The liquid carrier may constitute about 60% to 80% by weight of the electrostatic ink composition. The liquid carrier may constitute about 90% to 99.5% by weight of the electrostatic ink composition, in some examples 95% to 99% by weight of the electrostatic ink composition.

The electrostatic ink composition, when printed on a print substrate, may be substantially free from liquid carrier. In an electrostatic printing process and/or afterwards, the liquid carrier may be removed, e.g. by an electrophoresis processes during printing and/or evaporation, such that substantially just solids are transferred to the print substrate. Substantially free from liquid carrier may indicate that the ink printed on the print substrate contains less than 5 wt % liquid carrier, in some examples, less than 2 wt % liquid carrier, in some examples less than 1 wt % liquid carrier, in some examples less than 0.5 wt % liquid carrier. In some examples, the ink printed on the print substrate is free from liquid carrier.

Charge Director

In some examples, the electrostatic ink composition includes a charge director. The charge director may be added to an electrostatic ink composition in order to impart and/or maintain sufficient electrostatic charge on the ink particles. The charge director may be as described above for the charge director of the LEP adhesive composition.

In some examples, the charge director constitutes about 0.001% to 20%, in some examples 0.01% to 20% by weight, in some examples 0.01 to 10% by weight, in some examples 0.01% to 1% by weight of the solids of an electrostatic ink composition. In some examples, the charge director constitutes about 0.001% to 0.15% by weight of the solids of the electrostatic ink composition, in some examples 0.001% to 0.15%, in some examples 0.001% to 0.02% by weight of the solids of an electrostatic ink composition, in some examples 0.1% to 2% by weight of the solids of the electrostatic ink composition, in some examples 0.2% to 1.5% by weight of the solids of the electrostatic ink composition in some examples 0.1% to 1% by weight of the solids of the electrostatic ink composition, in some examples 0.2% to 0.8% by weight of the solids of the electrostatic ink composition.

In some examples, the charge director is present in an amount of from 3 mg/g to 20 mg/g, in some examples from 3 mg/g to 15 mg/g, in some examples from 10 mg/g to 15 mg/g, in some examples from 5 mg/g to 10 mg/g (where mg/g indicates mg per gram of solids of the electrostatic ink composition).

Other Additives

The LEP ink composition may include another additive or a plurality of other additives. The other additive or plurality of other additives may be selected from a charge adjuvant, a wax, a surfactant, viscosity modifiers, and compatibility additives. The wax may be an incompatible wax. As used herein, "incompatible wax" may refer to a wax that is incompatible with the resin. Specifically, the wax phase separates from the resin phase upon the cooling of the resin fused mixture on a print substrate during and after the transfer of the ink film to the print substrate, e.g. from an intermediate transfer member, which may be a heated blanket In some examples, the electrostatic ink composition includes a charge adjuvant. The charge adjuvant may be as described above for the charge adjuvant of the LEP adhesive composition. The LEP ink composition may comprise an amount of charge adjuvant as described above for the amount of charge adjuvant contained in the LEP adhesive composition.

Liquid Electrophotographic (LEP) Printing Composition Set

Described herein is a liquid electrophotographic printing composition set comprising a liquid electrophotographic (LEP) adhesive composition and a liquid electrophotographic (LEP) ink composition. The LEP adhesive composition and the LEP ink composition may be as described above.

In some examples, the LEP printing composition set comprises a plurality of LEP ink compositions and a LEP adhesive composition. In some examples, the plurality of LEP ink compositions may comprise a plurality of different LEP ink compositions, each of the plurality of different LEP ink compositions having a different colour (e.g. a CMYK set of LEP ink compositions).

Method of Printing and Embellishing

Described herein is a method comprising forming an adhesive image on a print substrate by electrophotographically printing a liquid electrophotographic adhesive composition as described herein on a print substrate.

Liquid electorphotographically printing a composition to a print substrate may comprise forming a latent electrostatic image on a surface of a photo-imaging plate (PIP), such as a photo-imaging cylinder, and contacting the LEP adhesive composition with the latent electrostatic image (by virtue of applying an electrical charge to the LEP adhesive composition such that the LEP adhesive composition is attracted to the latent electrostatic image on the PIP) to form an adhesive image on the PIP. The adhesive image is then transferred from the PIP to an intermediate transfer member (IM) by virtue of an appropriate potential applied between the PIP and the ITM, such that the charged LEP adhesive composition is attracted to the ITM. The adhesive image is the dried to form a film on the ITM before being transferred to a print substrate to form an adhesive image disposed on the print substrate.

In some examples, the method comprises transferring a number of layers of an adhesive image to the print substrate to form the final adhesive image on the print substrate. For example, the thickness of the adhesive image on the print substrate may be increased by printing more layers of adhesive image to the print substrate. A plurality of layers of an adhesive image may be LEP printed to the print substrate in "one-shot mode" or "multi-shot mode" (i.e. building up the plurality of layers of adhesive image on the ITM and transferring the plurality of adhesive image layers from the ITM to the print substrate, or transferring one adhesive image layer at a time from the PIP, via the ITM, to the print substrate respectively).

In some examples, the adhesive image formed on the print substrate has a thickness of at least about 1 μm, for example at least about 2 μm, at least about 3 μm, at least about 4 μm or at least about 5 μm. In some examples, the adhesive image formed on the print substrate has a thickness of up to about 15 μm, for example up to about 10 μm, or up to about 8 μm. In some examples, the adhesive image formed on the print substrate has a thickness of about 1 μm to about 15 μm.

In some examples, the method comprises forming an ink image on the print substrate such that the ink image is disposed on the print substrate and the adhesive image is disposed on the ink image. The ink image, for example a coloured or multi-coloured ink image may be formed on the print substrate by LEP printing a LEP ink composition onto the print substrate in a similar manner to the LEP printing of a LEP adhesive composition as described above. In some examples, the ink image (for example a plurality of layers of different coloured ink images), and the adhesive image (for example a plurality of layers of adhesive images) may be printed to the print substrate together in "one-shot mode" where the adhesive image is first formed on the ITM and then an ink image is formed on the adhesive image on the ITM before the ink image and adhesive image are transferred to the print substrate, or in "multi-shot mode" where each layer of ink image is built up on the print substrate before the adhesive image is transferred to the print substrate.

In some examples, the method comprises activating the adhesive image by applying water to the adhesive image. Water may be applied to the adhesive image by any suitable method. For example, water may be applied to the adhesive image by inkjet printing, spraying, treatment in water steam, wet tissue etc.

In some examples, applying water to the adhesive image comprises applying more than about 0.01 $g/m^2$ water to the adhesive image, for example at least about 0.02 $g/m^2$, at least about 0.03 $g/m^2$, at least about 0.04 $g/m^2$, or at least about 0.05 $g/m^2$ to the adhesive image. In some examples, applying water to the adhesive image comprises applying up to about 1 $g/m^2$ water to the adhesive image, for example up to about 0.5 $g/m^2$ or up to about 0.3 $g/m^2$ water to the adhesive image. In some examples, applying water to the adhesive image comprises applying from about 0.05 to about 0.5 $g/m^2$, for example about 0.05 to about 0.3 $g/m^2$ water to the adhesive image.

An embellishing material may be applied to the activated adhesive image such that the embellishing material adheres to the activated adhesive image. It has been found that employing the LEP adhesive composition described herein to form an adhesive image that is activated by applying water to the adhesive image allows an embellishing material to be adhered to the adhesive image without adhering to a background LEP ink image (even if water is also applied to the LEP ink image).

The embellishing material may be applied to the activated adhesive image by contacting the embellishing material with the activated adhesive image. Pressure may be applied in order to adhere the embellishing material to the activated adhesive image. In some examples, pressure is applied via a roller, or a series of roller, for example using a roll laminator.

The embellishing material may be contacted with the activated adhesive image and adhered to the activated adhesive image under conditions of ambient temperature. For example at temperatures of less than about 50° C., for example about 45° C. or less, for example about 25° C.

Print Substrate

The print substrate may be any suitable substrate. The print substrate may be any suitable substrate capable of having an image printed thereon. The print substrate may include a material selected from an organic or inorganic material. The material may include a natural polymeric material, e.g. cellulose. The material may include a synthetic polymeric material, e.g. a polymer formed from alkylene monomers, including, for example, polyethylene and polypropylene, and co-polymers such as styrene-polybutadiene. The polypropylene may, in some examples, be biaxial orientated polypropylene. The material may include a metal, which may be in sheet form. The metal may be selected from or made from, for instance, aluminium (Al), silver (Ag), tin (Sn), copper (Cu), mixtures thereof. In an example, the substrate includes a cellulosic paper. In an example, the cellulosic paper is coated with a polymeric material, e.g. a polymer formed from styrene-butadiene resin. In some examples, the cellulosic paper has an inorganic material bound to its surface (before printing with ink) with a polymeric material, wherein the inorganic material may be selected from, for example, kaolinite or calcium carbonate. The substrate is, in some examples, a cellulosic print substrate such as paper. The cellulosic print substrate is, in some examples, a coated cellulosic print. In some examples, a primer may be coated onto the print substrate, before the LEP ink is printed onto the print substrate. In some examples, the print substrate is a transparent print substrate, for example the print substrate may be formed from a transparent material such as a transparent polymeric material, e.g. a polymer formed from alkylene monomers, including, for example, polyethylene and polypropylene, and co-polymers such as styrene-polybutadiene.

Embellishing Material

The embellishing material may be any suitable material to be applied to a print substrate to embellish a LEP ink image. In some examples, the embellishing material is a foiling material.

In some examples, the foiling material may comprise any suitable foiling material. In some examples, the foiling material comprises any frangible material. In some examples, the foiling material may comprise a material that is so thin that it is frangible.

In some examples, a carrier layer is applied to a surface of the foiling material. In some examples, the carrier layer is a polymeric film. In some examples, the polymeric film is a polyester film or a Teflon®-based film. In some examples, the carrier layer is applied to the surface of the foiling material before the foiling material is contacted with the activated LEP adhesive composition to aid application of the foiling material to the substrate. In some examples, the carrier layer is applied to the opposing surface of the foiling material from the surface that will be contacted with the activated LEP adhesive composition. In some examples, after the foiling material is contacted with the activated LEP adhesive composition, the carrier layer is removed from the foiling material. In some examples, the removal of the carrier layer from the foiling material also removes any foiling material that has not adhered to the activated LEP adhesive composition, for example foiling material that was in contact with the LEP ink image instead of the activated LEP adhesive composition. In some examples, the removal of the carrier layer from the foiling material also removes foiling material that has not adhered to the activated LEP adhesive composition, which may be foiling material that was in contact with the LEP ink composition. In some examples, the carrier layer comprises a release material and a carrier material and the release material contacts the surface of the foiling material.

In some examples, the foiling material is a metallic material. In some examples, the foiling material is a tissue-like material coated with metal or a component with a metallic appearance. In some examples, the foiling material is a polymeric film such as a polyester film or a polyester metalized film, or a Teflon®-based film. In some examples, the foiling material is a smooth polyester metalized film.

In some examples, the foiling material may be bright, glossy, pearlescent, dull or matte in appearance. The foiling material may have any colour, including gold, silver, red, blue, orange, pink, green, purple, cyan, yellow, magenta, white or black. In some examples, the foiling material may be patterned, for example, a wood grain pattern or a cobblestone pattern. In some examples, the foiling material may be opaque. In other examples, the foiling material may be transparent or semi-transparent.

In some examples, the foiling material has a metallic appearance. In some examples, the foiling material provides optical effects to the substrate. In some examples, the optical effects are holographic effects. In some examples, the foiling material is semi-translucent. In some examples, the foiling material is a glossing material, that is, a material that provides a gloss. In some examples, the foiling material is a smoothing film.

In some examples, the foiling material has a thickness of 200 μm or less, in some examples, the foiling material has a thickness of 100 μm or less, in some examples, the foiling material has a thickness of 50 μm or less, in some examples, the foiling material has a thickness of 25 μm or less.

In some examples, the foiling material has a thickness of 1 μm or more, in some examples, the foiling material has a thickness of 5 μm or more, in some examples, the foiling material has a thickness of 10 μm or more, in some examples, the foiling material has a thickness of 15 μm or more.

In some examples, the foiling material has a thickness of 1 to 200 μm, in some examples, the foiling material has a thickness of 5 to 100 μm, in some examples, the foiling material has a thickness of 10 to 50 μm, in some examples, the foiling material has a thickness of 15 to 25 μm.

EXAMPLES

The following illustrates examples of the compositions and related aspects described herein. Thus, these examples should not be considered to restrict the present disclosure, but are merely in place to teach how to make examples of compositions of the present disclosure.

Example 1

A LEP adhesive composition was prepared by grinding together a mixture of 43.32 g of a paste comprising a thermoplastic resin (Nucrel® 699 (available from DuPont: a copolymer of ethylene and methacrylic acid, made with nominally 11 wt. % methacrylic acid) and AC®-5120 (available from Honeywell: a copolymer of ethylene and acrylic acid with an acid number of 112-130 KOH/g) in a ratio of 4:1 by weight in Isopar™ L such that the paste contains 25% solids by total weight of the paste), 26.6 g of a moisture activatable adhesive (acacia gum (also known as gum arabic) available from Sigma Aldrich), 0.57 g aluminium stearate (VCA available from Sigma Aldrich) and 129.51 g Isopar™ L (available from Exxon Mobil) in an attritor (laboratory 01 HD attritor from Union Process (USA)) at 25° C. for 24 hours. After grinding the mixture was diluted to 2 wt % solids by total weight of the composition by addition of Isopar™ L. A charge director (NCD: a natural charge director having the components (i) natural soya lecithin, (ii) basic barium petronate, and (iii) dodecyl benzene sulfonic acid, amine salt, with the components (i), (ii) and (iii) being present in the weight ratios of 6.6%:9.8%:3.6%) was added to the diluted composition (0.1 wt. % to 0.3 wt. % of the solids of the ink). The resulting composition was kept at room temperature overnight before printing.

The formulation of the LEP adhesive composition of Example 1 is set out in Table 1 below.

TABLE 1

| Component | Weight in composition | wt % solids in formulation |
|---|---|---|
| Thermoplastic resin (Nucrel ® 699 and AC ®-5120) | 10.83 g | 28.5 |
| Moisture activatable adhesive (*Acacia* gum) | 26.6 | 70 |
| VCA | 0.57 | 1.5 |
| Isopar ™ L | 1862 | |
| NCD | 0.3-0.5 | 0.1-0.3 |

Example 2

A LEP adhesive composition was prepared according to Example 2 except that hydroxyl methyl cellulose (available from Sigma Aldrich) was used as the moisture activatable adhesive instead of acacia gum.

The formulation of the LEP adhesive composition of Example 2 is set out in Table 2 below.

TABLE 2

| Component | Weight in composition | wt % solids in formulation |
|---|---|---|
| Thermoplastic resin (Nucrel ® 699 and AC ®-5120) | 10.83 g | 28.5 |
| Moisture activatable adhesive (hydroxyl methyl cellulose) | 26.6 | 70.0 |
| VCA | 0.57 | 1.5 |
| Isopar ™ L | 1862 | |
| NCD | 0.3-0.5 | 0.1-0.3 |

Testing

Example 3

A liquid electrophotographic printing apparatus (HP indigo 7000 press) was loaded with LEP ink (cyan ElectroInk® 4.5 (available from HP Indigo)) and the LEP adhesive composition of Example 1. The cyan ink was printed at 100% coverage onto a print substrate (standard Condat paper 130 g) and a selected area of the cyan ink image was printed with the LEP adhesive composition such that an adhesive image was formed on top of the ink image (4 separations of the LEP adhesive composition was printed to form the adhesive image having a thickness of approximately 4 microns).

The print substrate comprising the ink image and the adhesive image disposed thereon was transferred to an EpsonL130 (5760 dpi) ink jet printer charged with filtered water (filtered using a 0.45 m filter while degassing) comprising 0.5% of surfactant (Surfynol® 465 from Air Products™). Water was applied to the entire surface of the print substrate comprising the ink image and the adhesive image at a coverage of 30-50% (according to grey scale coverage) in order to activate the adhesive image.

Foil (GMP, Metallic gold) was applied to the wetted surface of the printed substrate comprising the ink image and the adhesive image immediately after wetting using a laminator (GMP EXCELAM PLUS 355RM laminator). The printed substrate with the foil was passed through the laminator nip at a speed of 1 m/min and a pressure of about 1 kg/m$^2$ at ambient temperature (25-40° C.). A foil carrier layer was removed about 0.5-1 minute after the foiled substrate was removed from the nip.

Example 4

Example 3 was repeated except that the LEP adhesive composition of Example 2 was used in place of the LEP adhesive composition of Example 1.

For both the foiled printed substrates of Examples 3 and 4, foil was found to have only adhered to the adhesive image (i.e. there was no background contamination of the wetted ink image on which no adhesive image was formed with the foil). The foil coverage of the adhesive image for both Examples 3 and 4 was found to be about 100%.

Therefore, the LEP adhesive compositions of Examples 1 and 2 were found to provide an adhesive that can be activated using water, i.e. without heat and/or chemical treatment, and which provides for excellent selective embellishment of LEP printed substrates.

The present inventors have found that methods for embellishing LEP printed substrates using embellishing materials such as foil using the LEP adhesive compositions described herein, such as those of Examples 1 and 2, provide for improved selective embellishment of LEP printed substrates compared to previous methods for embellishing LEP printed substrates such as, for example, methods employing heat activated LEP adhesive compositions. The present inventors have found that employing the LEP adhesive compositions described herein provide for embellishment of an adhesive image without background contamination caused by an embellishing material such as foil adhering to an LEP ink composition. Without wishing to be bound by theory, it is thought that the LEP adhesive compositions described herein can be activated (i.e. by applying water) without causing the LEP ink composition to act as an adhesive and therefore allowing an embellishing material to adhere to the LEP adhesive image without adhering to the background LEP ink image.

Further Experiments

The present inventors carried out additional experiments to investigate the effect of the amount of moisture activatable adhesive contained in the LEP adhesive composition on the final coverage of foil on an adhesive image using the process described in Examples 3. Various compositions were produced corresponding to the composition of Example 1 except that the amount of acacia gum included in the formulations was varied. The compositions were printed and foiled as described in Example 3. The results indicated that LEP adhesive compositions containing low amounts (for example about 20 wt % or less by total soils of the LEP adhesive composition) of moisture activatable adhesive resulted in low/no foil coverage. It was found that compositions containing at least about 30 wt % of the moisture activatable adhesive by total solids provided adhesive images to which foil adhered, with further improved foiling being obtained for LEP adhesive compositions containing at least about 50 wt % by total solids of the moisture activatable adhesive and even further improved foiling results being obtained for LEP adhesive compositions comprising about 70 wt % by total solids of the moisture activatable adhesive. It was found that there may be an upper limit on the amount of moisture activatable adhesive which may be present in the LEP adhesive composition such that the LEP adhesive composition is still printable liquid electrophotographically. For example, printing difficulties were found for a LEP adhesive composition comprising greater than about 80 wt % by total solids of acacia gum.

Following these experiments, the present inventors understand that the amount of moisture activatable adhesive contained in the LEP adhesive composition to provide the most improved compositions for embellishing (e.g. foiling) a printed substrate is from about 30 wt % to about 80 wt %, for example about 30 wt % to about 75 wt %, about 30 wt % to about 70 wt %, about 50 wt % to about 70 wt %, or about 70 wt % by total solids of the LEP adhesive composition.

The present inventors have also found that for LEP adhesive compositions comprising lower amounts of moisture activatable adhesive, the foiling performance can be improved by increasing the number of layers of adhesive image printed to the print substrate. For example, increasing the number of layers of adhesive image provided using the LEP adhesive compositions of Examples 1 and 2 (as described in Examples 3 and 4) from 2 to 4, increased the amount of foil coverage on the adhesive image from less than about 50% to about 100%. It has been observed that printing one layer of a LEP adhesive composition as describes herein provides an LEP adhesive image having a thickness of about 1 μm.

The present inventors have also found that other moisture activatable adhesives, such as 2-hydroxy ethyl cellulose, hydroxypropyl methyl cellulose, ethyl hydroxyethyl cellulose, methyl (2-hydroxypropyl) cellulose, methyl cellulose, xantham gum, agar (agarose), powdered gelatin, polyvinyl alcohol, polyvinyl esters (such as polyvinyl acetate) may be used to print moisture activatable adhesive images similarly to those described above in relation to acacia gum and hydroxyl methyl cellulose.

While the liquid electrophotographic compositions, methods and related aspects have been described with reference to certain examples, it will be appreciated that various modifications, changes, omissions, and substitutions can be made without departing from the spirit of the disclosure. It is intended, therefore, that the liquid electrophotographic compositions, methods and related aspects be limited only by the scope of the following claims. Unless otherwise stated, the features of any dependent claim can be combined with the features of any of the other dependent claims, and any other independent claim.

The invention claimed is:

1. A liquid electrophotographic adhesive composition comprising:
- a thermoplastic resin;
- at least 70 wt % to about 90 wt % of a moisture activatable adhesive by total solids of the composition; and
- an insulating, non-polar, non-aqueous liquid carrier;
- wherein the adhesive composition is transparent and substantially free from pigment;
- and wherein the moisture activatable adhesive is selected from the group consisting of cellulose derivatives, natural gums, gelatin, and combinations thereof.

2. A composition according to claim 1, wherein the moisture activatable adhesive is selected from the group consisting of hydroxyl methyl cellulose, 2-hydroxy ethyl cellulose, hydroxypropyl methyl cellulose, ethyl hydroxyethyl cellulose, methyl (2-hydroxypropyl) cellulose, methyl cellulose, xantham gum, agar, and acacia gum.

3. A composition according to claim 1, wherein the thermoplastic resin comprises a copolymer of an alkylene monomer and a monomer selected from acrylic acid and methacrylic acid.

4. A composition according to claim 1 comprising the thermoplastic resin in an amount from about 15 wt % to about 70 wt % by total solids of the composition.

5. A composition according to claim 1 comprising a charge director.

6. A composition according to claim 1 comprising a charge adjuvant.

7. A method comprising:
- forming an adhesive image on a print substrate by electrophotographically printing the liquid electrophotographic adhesive composition of claim 1 on to the print substrate;
- activating the adhesive image by applying water to the adhesive image; and
- applying an embellishing material to the activated adhesive image such that the embellishing material adheres to the activated adhesive image.

8. A method according to claim 7, wherein the adhesive image has a thickness of about 1 μm to about 15 μm.

9. A method according to claim 7, wherein activating the adhesive images comprises applying water to the adhesive image in an amount of about 0.05 to about 0.5 $g/m^2$.

10. A method according to claim 7, wherein applying an embellishing material to the activated adhesive image comprises applying the embellishing material to the activated adhesive image at a temperature of less than about 50° C.

11. A method according to claim 7, comprising forming an ink image on a print substrate by electrophotographically printing a liquid electrophotographic ink composition comprising a thermoplastic resin, a pigment and a liquid carrier on to the print substrate such that the ink image is disposed on the print substrate and the adhesive image is disposed on the ink image.

12. A liquid electrophotographic printing composition set comprising:
- the liquid electrophotographic adhesive composition of claim 1;
- and
- a liquid electrophotographic ink composition comprising:
  - a thermoplastic resin;
  - a pigment; and
  - a liquid carrier.

13. A set according to claim 12, wherein the thermoplastic resin of the liquid electrophotographic adhesive composition comprises a copolymer of an alkylene monomer and a monomer selected from acrylic acid and methacrylic acid and the thermoplastic resin of the liquid electrophotographic ink composition comprises a copolymer of an alkylene monomer and a monomer selected from acrylic acid and methacrylic acid.

14. A composition according to claim 1, wherein the moisture activatable adhesive is selected from the group consisting of hydroxy methyl cellulose and acacia gum.

15. A liquid electrophotographic adhesive composition comprising:

a thermoplastic resin;

at least about 70 wt % to about 90 wt % of a moisture activatable adhesive by total solids of the composition; and an insulating, non-polar, non-aqueous liquid carrier;

wherein the adhesive composition is transparent and substantially free from pigment;

and wherein the moisture activatable adhesive is acacia gum.

* * * * *